United States Patent [19]

Forsberg

[11] Patent Number: 4,804,463

[45] Date of Patent: Feb. 14, 1989

[54] GRAVITY SEPARATOR

[75] Inventor: Irvine F. Forsberg, Thief River Falls, Minn.

[73] Assignee: Forsbergs, Inc., Thief River Falls, Minn.

[21] Appl. No.: 124,384

[22] Filed: Nov. 20, 1987

Related U.S. Application Data

[63] Continuation of Ser. No. 837,408, Mar. 7, 1986, abandoned.

[51] Int. Cl.[4] ..... B03B 4/00; B03B 5/24

[52] U.S. Cl. ..... 209/466; 209/502; 209/504

[58] Field of Search ..... 209/466, 467, 468, 469, 209/470, 20, 502, 503, 504

[56] References Cited

U.S. PATENT DOCUMENTS

| | | | |
|---|---|---|---|
| Re. 19,021 | 12/1933 | Peale | 209/469 |
| 879,069 | 2/1908 | Tolmie . | |
| 1,194,477 | 8/1916 | Chevalier et al. . | |
| 1,733,380 | 10/1929 | McCartney . | |
| 1,811,026 | 6/1931 | Raw | 209/502 |
| 1,868,896 | 7/1932 | Goold | 209/467 |
| 2,150,298 | 3/1939 | Taylor | 209/467 |
| 2,257,624 | 9/1941 | Sutton et al. | 209/4 |
| 2,404,414 | 7/1946 | Sutton | 209/467 |
| 2,835,388 | 5/1958 | McLean | 209/502 X |
| 3,040,892 | 6/1962 | Linkinhoker | 209/467 |
| 3,406,824 | 10/1968 | Forsberg | 209/467 |
| 3,486,620 | 12/1969 | Stolle | 209/467 |
| 3,530,987 | 9/1970 | Kipp | 209/467 |
| 3,852,168 | 12/1974 | Oetiker | 209/469 |
| 3,888,352 | 6/1975 | Kulseth | 209/115 |
| 4,282,091 | 8/1981 | Carter | 209/467 |
| 4,515,276 | 5/1985 | Feller et al. | 209/470 X |

FOREIGN PATENT DOCUMENTS

| | | | |
|---|---|---|---|
| 393981 | 6/1933 | United Kingdom | 209/502 |

*Primary Examiner*—Andres Kashnikow
*Assistant Examiner*—Patrick N. Burkhart
*Attorney, Agent, or Firm*—Palmatier & Sjoquist

[57] ABSTRACT

The present invention is a gravity separator for classifying particulate matter as to weight. The invention herein uses a screened vibrating deck having a flow of air therethrough for separating the particulate matter placed thereon. The air flow is provided by a fan, located centrally of the housing below the deck and, which fan rotates about a vertical axis. Movement is imparted to the deck by a drive rod connected to an eccentric shaft. The eccentric shaft rotates about an axis transverse to the fan shaft. A single drive motor is used to operate both the eccentric shaft and the fan.

3 Claims, 3 Drawing Sheets

GRAVITY SEPARATOR

This is a continuation of copending Ser. No. 837,408 filed on Mar. 7, 1986 abandoned.

FIELD OF THE INVENTION

The present invention relates to gravity separators that utilize air flow and vibration to separate particulate matter.

BACKGROUND OF THE INVENTION

Various gravity separators are known in the prior art that utilize a flow of air and vibration for separating and grading particulate matter, such as grain or minerals, as to weight or size. See for example, U.S. Pat. Nos. 3,486,620 issued Dec. 30, 1969 to Stolle, and 1,194,477 issued Aug. 15, 1916 to Chevalier et al. Such gravity separators employ a gently sloping and vibrating deck that is perforate to allow the air to flow therethrough. Particulate matter placed on a lower corner of the deck will be partially supported off the deck by the air flow so that it can move in a fluid fashion. The vibration urges the particles up the gentle slope of the deck wherein the heaviest particles reach the highest point of the deck. Thus, the material is classified uniformally by decreasing weight in a direction from the top end to the bottom end of the deck.

The vibratory motion is imparted to the deck by a drive rod or rods pivotally connected on one end to the deck and on their other end to an eccentric shaft. Rotation of the shaft moves the rod in a back and forth motion, thereby vibrating the deck. A counterweight mechanism is generally employed to oppose the motion of the deck to minimize vibration in the machine caused by the deck movement. However, a counterweight mechanism does not eliminate all vibration associated with operation of current art gravity separators. Substantial vibration continues to occur as a result of the motion of various components, other than the deck. Such vibration, overtime, can cause damage to these various parts, and thus, premature failure of the machine.

In addition, it has become increasingly important, particularly with separators used to process grains, that the amount of energy required to operate the machine, and thus the cost of operating the machine, be minimized. Prior art gravity separators work satisfactorily but consume a substantial amount of energy. A major inefficiency concerns the placement of the fan, for creating the air flow through the deck, in a position substantially away from the deck. See for example, U.S. Pat. No. 2,257,614 issued Sept. 30, 1941 to Sutton et al. As a result of such placement, air cannot be delivered directly and evenly through the deck, thereby decreasing the effectiveness of the airflow produced by the fan.

SUMMARY OF THE INVENTION

An object of the present invention is to provide for an improved gravity separator designed to prevent the tendency for vibrations to occur during the operation thereof.

Another object of the invention is to provide for an improved separator that reduces the amount of energy required to separate given amount of particulate matter.

A feature of the present invention is a fan located substantially centrally of the housing and supported by a sheet metal partition extending through the housing in a horizontal plane substantially parallel with the base of the housing. The partition includes a venturi portion at its center upon which the fan is affixed. The fan shaft extends in a vertical axis, and a plurality of air vents are located around the perimeter of the base of the housing for providing air to the fan.

Another feature of the present invention concerns an eccentric shaft mounted on a rigid rectangular frame within the housing. The eccentric shaft extends in a horizontal axis, perpendicular to the axis of rotation of the fan, and parallel with the end of the frame to which it is secured. A drive rod is rotatively connected on one end to the eccentric shaft and on its other end to the deck.

A drive motor is secured to an end of the frame opposite the end of attachment of the eccentric shaft. The drive motor rotates about a vertical axis parallel with the axis of rotation of the fan, and is rotatively engaged therewith by a belt and pulley system.

A further belt and pulley system provide for rotational coupling of the motor to the eccentric shaft. A jack shaft drive belt runs from the drive motor along the side of the frame to which the motor is attached, and is then directed through an angle of 90° by idler pulleys to run along the side of the frame extending between the eccentric shaft frame side and the motor frame side, to a jack shaft pulley on a jack shaft. The jack shaft is located adjacent the eccentric shaft and rotates about a horizontal axis parallel thereto. The jack shaft is rotationally coupled to the eccentric shaft by a belt extending around an eccentric shaft pulley and a further pulley of the jack shaft.

The basic operation of the present invention can be appreciated wherein rotation of the drive motor will, through the fan belt, operate the fan. The fan then pulls air through the vents, into the venturi, and into a plenum area defined by the housing and the sheet metal partition. This plenum area is presssurized relative to the exterior of the housing by the action of the fan. The pressure created within the plenum by the actions of the fan results in a flow of air through the deck.

Rotation of the eccentric shaft is imparted thereto by the belt coupling the drive motor to the jack shaft, and ultimately, by the belt coupling the jack shaft to the eccentric shaft. Rotation of the eccentric shaft accuates the drive rod thereby vibrating the deck. The present invention also includes a counterweight mechanism rotatively affixed to the eccentric shaft for opposing the motion of the deck.

A principle advantage of the present invention concerns the axis of rotation of the eccentric shaft being transverse to that of the fan shaft. This transverse relationship of the fan and the eccentric shafts helps to minimize the occurance of vibrations in the present invention, as any vibration about one axis will, in a gyroscopic fashion, tend to cancel any vibration about the opposite axis. In addition, the drive mechanism for the eccentric shaft, namely the drive motor, idler pulleys and eccentric shaft itself, exists substantially around the periphery of the partition thereby minimizing any air flow reducing obstructions between the fan and the deck.

Another advantage of the present invention concerns the central location of the fan within the inner housing which provides for less air turbulance within the plenum, and thus, a more even and efficient air flow to the deck. In addition, the venturi facilitates the flow of air from the vents to the fan so that the fan does not have to work as hard to pressurize the plenum. Also, the vents located around the entire perimeter of the base of the housing provide for an essentially unrestricted supply of air to the fan.

A further advantage of the present invention is that only one drive motor is needed to operate both the deck and the fan. In this manner, further energy efficiency is obtained as opposed to the use of separate drive motors for the fan and the deck.

DESCRIPTION OF THE DRAWINGS

The following detailed description of the preferred embodiments will specifically refer to the following figures wherein.

DETAILED DESCRIPTION OF THE PREFERRED EMBODIMENTS

Figure 1:
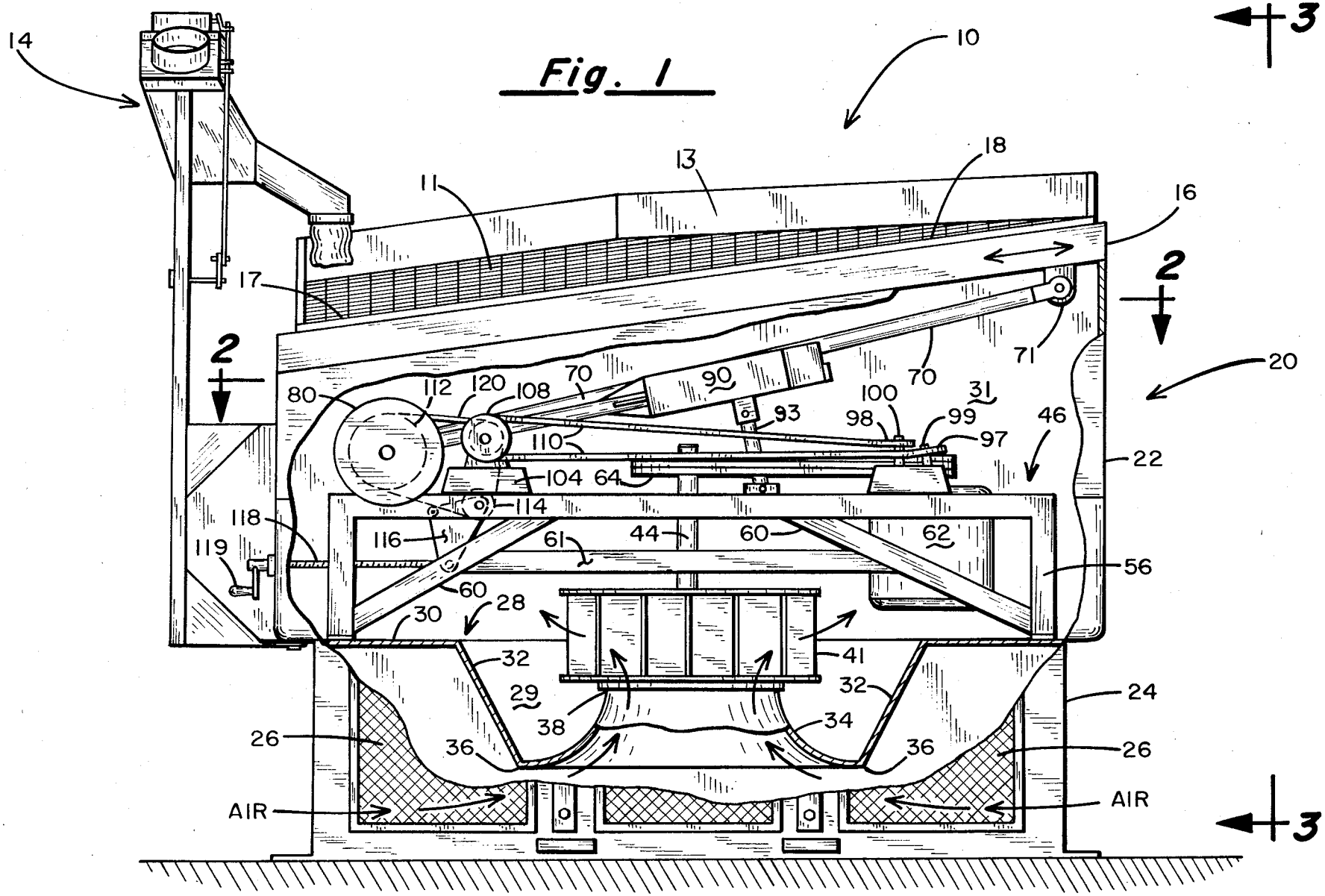
FIG. 1 is a side elevation view of the present invention with a portion cut away to reveal the internal mechanism thereof.
Figure 3:
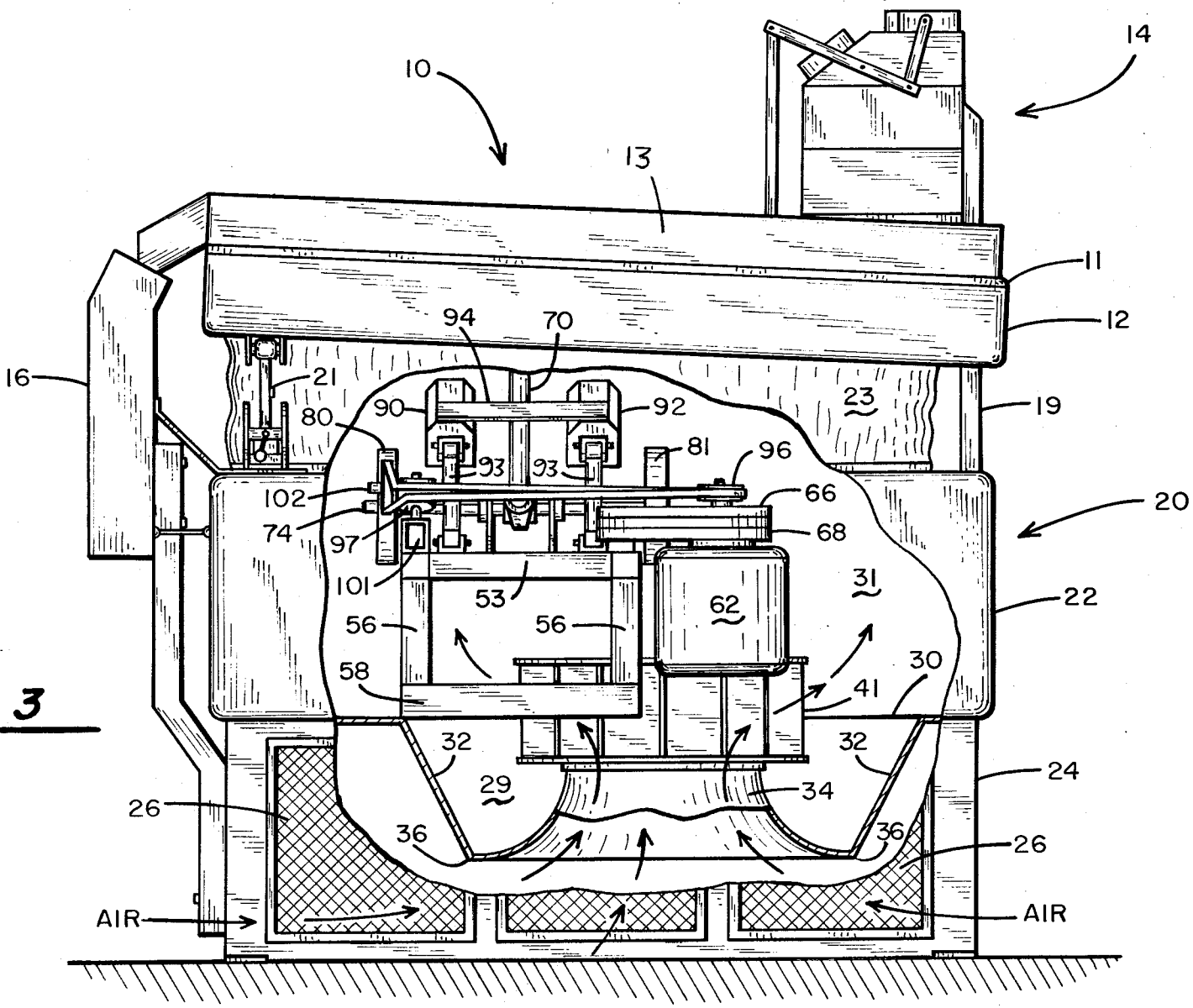
FIG. 3 is a side elevation view of the present invention with a portion cut away to reveal the internal mechanism thereof.

The gravity separator of the present invention is seen in FIGS. 1 and 3 and generally designated 10. Separator 10 includes a screened deck 11 that is trapezoidal in shape and is held within a frame or shoe 12. Deck 11 gently slopes in an upwardly direction from feed inlet mechanism 14 to discharge mechanism 16, and also upwardly in a direction from a lower deck end 17 to an upper deck end 18. Flanges 13 are affixed to deck 11 around its perimeter and extend upwardly therefrom, except along the side of deck 11 to which discharge mechanism 16 is attached. Separator 10 also includes a lower housing generally designated 20. Shoe 12 is supported above housing 20 by support 19, and adjustable support 21. A bellows 23 extends downwardly from shoe 12 around the perimeter thereof and is secured in an airtight fashion thereto, and to housing 20. Lower housing 20 includes an upper portion 22 rectangular in shape and formed of sheet metal, and a lower portion 24, also rectangular and formed of a sheet metal, and sized somewhat smaller than upper portion 22. A plurality of screened air vents 26 are located in lower portion 24 around the entire perimeter thereof.

A sheet metal partition 28 extends through housing 20 and has an upper portion 30 running perpendicularly to, and between upper and lower housing portions 22 and 24. Partition 28 has a recessed area 29 defined by a lower angled plenum portion 32 that depends from upper portion 30 at an oblique angle, to a venturi 34. Partition 28 creates a plenum area 31 within housing 20 above support 28. Venturi 34 has an arcuate convex shape running inwardly and upwardly from points 36 at the end of angled portions 30 to a top venturi end 38. A fan 41 is attached to a fan shaft 44. Fan shaft 44 extends in a vertical axis perpendicular to the plane of the upper end of the housing. Fan 41 is a centrifugal fan of the radial flow type.

Figure 2:
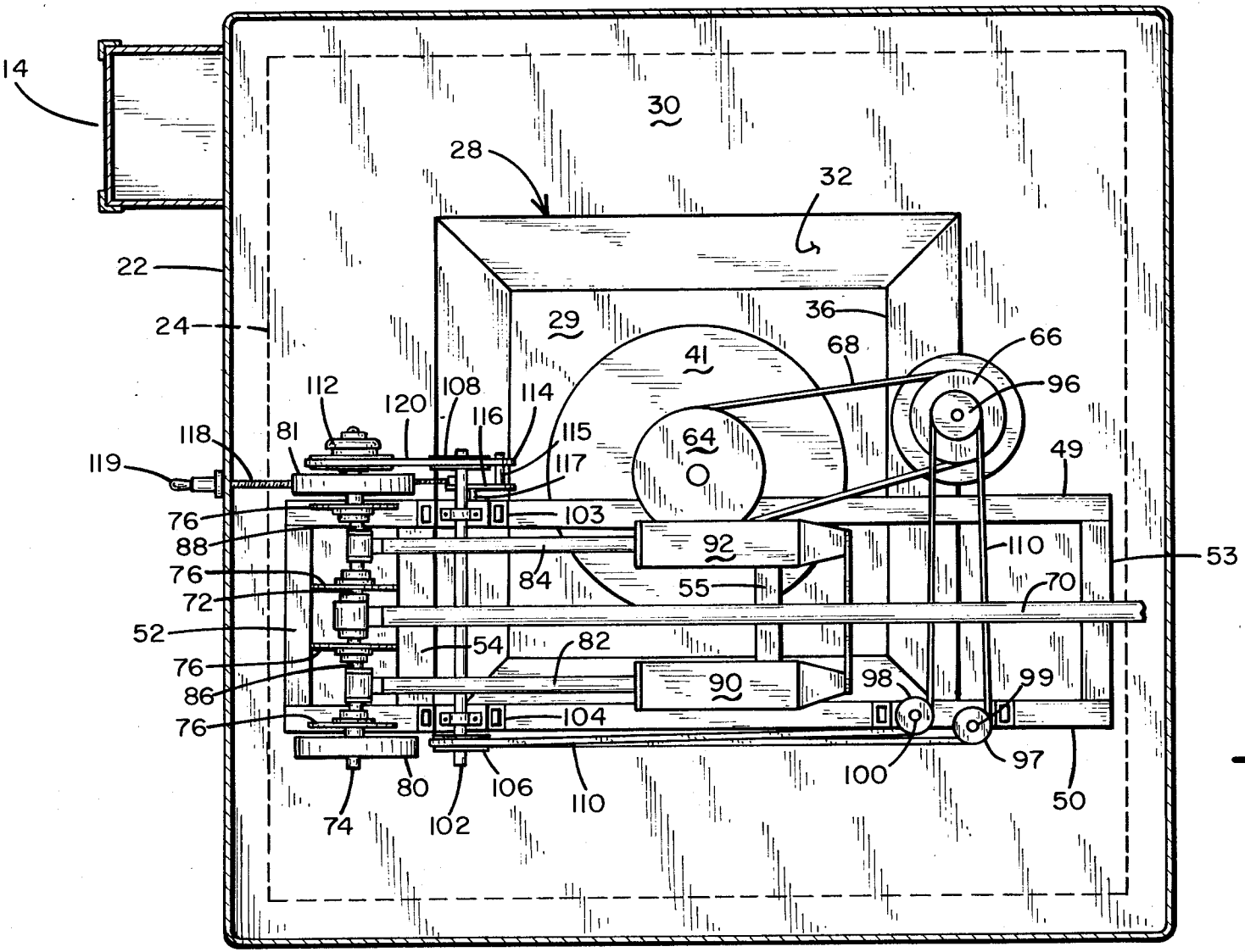
FIG. 2 is an elevation view along lines 2—2 of FIG. 1.

The present invention, as seen in FIGS. 1, 2 and 3, includes a rigid support frame 46. Support frame 46 is constructed of rectangular hollow steel stock and includes a top frame formed of side members 49 and 50, end members 52 and 53, intermediate members 54 and 55. Four legs 56 depend from the corners of frame 46 to lower frame support members 58. Lower support members 58 are affixed to legs 56, and also to the top of lower housing portion 24. Frame 46 also includes angled support members 60 affixed to the bottoms of legs 56 and running upwardly and affixed to upper members 49 and 50, and horizontal support 61.

A motor 62 is affixed to frame 46 along side member 49 adjacent end member 53. A triple pulley 64 is attached to the end of fan shaft 44 opposite the end of attachment of fan 41, and shaft 44 is rotatively secured to frame 46. A similar triple pulley 66, sized somewhat smaller in diameter than pulley 64 is attached to the end of the drive shaft of motor 62. Three fan belts 68 connect pulley 64 to 66.

A deck drive rod 70 is attached on one end to shoe 12 by a drive rod pivot 71, and on its opposite end to an eccentric crank 72. Eccentric crank 72 is attached to eccentric shaft 74 which extends in a horizontal axis parallel with end member 52 and is located on frame 46 adjacent thereto. Shaft 74 is rotatively connected by support 76 to support members 52 and 54. Flywheels 80 and 81 are attached to each end of shaft 74. Counterweight rods 82 and 84 are rotatively connected on one end to cranks 86 and 88 on either side of drive rod crank 72, and on their opposite ends secured to counterweights 90 and 92 respectively. Counterweights 90 and 92 are each pivotally secured on one end of supports 93, and the other ends of supports 93 are pivotally secured to frame member 55. Weights 90 and 92 are connected by means of bar 94 extending between and connecting the ends thereof. Counter weight cranks 86 and 88 are 180° out of phase with drive rod crank 72.

Motor 62 includes a pulley 96 located above triple motor pulley 66. Two idler pulleys 97 and 98 are rotatively attached on one end of shafts 99 and 100 respectively. The opposite ends of shafts 99 and 100 are secured to support 101 affixed to side member 50 essentially in a position across from motor 62, and shaft 99 extends at an oblique angle from side member 50. A jack shaft 102 is rotatively mounted to supports 103 and 104 and attached thereby to side members 48 and 50 respectively. Shaft 102 runs across frame 46 parallel with and adjacent to eccentric shaft 74. A jack shaft pulley 106 is attached to the end of jack shaft 102 adjacent side member 48 and a second jack shaft pulley 108 is attached to the end of jack shaft 102 adjacent side member 50.

As seen most clearly in FIG. 2, a jack shaft belt 110 connects motor pulley 96 to jack shaft pulley 106. Belt 110 initially runs in a direction parallel with end member 53 from pulley 96 to pulleys 97 and 98. Pulleys 97 and 98 serve to redirect belt 110 through an angle of 90° to run in a direction parallel with side member 50. Specifically, belt 110 travels from pulley 96 to pulley 97 and is translated thereby through an angle of 90° towards pulley 106. The angle at which shaft 99, and hence pulley 97 is set, helps to direct belt 110 to the bottom of pulley 106. As pulley 96 rotates about the axis of drive motor 62, which axis is perpendicular to the axis of rotation of jack shaft 102, it can be appreciated that from pulley 97 to pulley 106, belt 110 is also rotated through an angle of 90° to correspond to the change in axial rotation of pulley 106. Belt 110 then runs from the bottom, around, and then off the top of pulley 106 and is routed towards pulley 98. Belt 110 is again rotated through an angle of 90° between pulleys 106 and 98 to correspond to the different axes or rotation thereof. Belt 110 then runs around pulley 98 and is directed thereby back to pulley 96.

A spring biased pulley 112 is attached to the end of eccentric shaft 72 adjacent flywheel 81. An idler pulley 114 is rotatively attached on one end of a shaft 115 and the other end of shaft 115 is affixed to a triangular support 116. Support 116 is pivotally secured to side member 50 by shaft 117. A threaded rod 118 is on one end threadably engaged with support 116 and extends therefrom to the exterior of housing 20, and on its opposite end is secured to a crank handle 119. An eccentric shaft belt 120 connects pulleys 112, 108 and 114.

The basic operation of the present invention can now be appreciated wherein belts 68, through pulleys 64 and 66, impart the rotation of drive motor 62 to fan 41 through fan shaft 44. Fan 41 then pulls air in the direction as indicated by the arrows through vents 26 and venturi 34 into plenum 31. The air pressure in plenum area 31 is increased by the action of fan 41 relative to the exterior of plenum 31. The pressure created within plenum 31 is relieved through the screened deck resulting in a flow of air therethrough. The substantially central location of fan 41 provides for an even pressurization of plenum 31, and thus minimizes the creation of turbulence therein. Such turbulence can reduce the flow of air through the deck, thereby decreasing the efficiency of operation of fan 41. In addition, venturi 34 provides for a smooth flow of air from vents 26 to fan 41 thereby decreasing the work load on fan 41. Vents 26 are screened to prevent particulate matter from entering separator 10, and due to their large surface area also improve the operating efficiency of fan 41 by providing an essentially unrestricted supply of air. An air damping mechanism, not shown, is located in venturi 34 and is used to control the amount of air flowing there through to fan 41. Thus, the strength of the air flow can be adjusted to match the requirements of the particular material being separated.

Drive motor 62 also serves to rotate jack shaft 72 by belt 110, connecting pulleys 96 and 106. Rotation of jack shaft 102 is thus imparted to eccentric shaft 74 by belt 118 running around pulleys 112, 108 and 114. Rotation of eccentric shaft 74 thus operates eccentric crank 72 thereby moving drive rod 70. Jack shaft 102 provides for suitable drive reduction to eccentric shaft 74 of the rotational driving speed of drive motor 62. It can be appreciated by those skilled in the art that jack shaft 102 can be rotatively coupled to eccentric shaft 74 at either end of eccentric shaft 74. The eccentric movement of crank 72 is imparted to shoe 12 by rod 70 through pivot 71, thereby oscillating deck 11 in a relative back and forth vibrating motion. As counterweight cranks 86 and 88 are 180° out of phase with eccentric crank 72, counterweights 90 and 92 move in an opposite motion with respect to drive rod 70 and hence deck 11. In this manner, counter weights 90 and 92 serve to cancel the motion imparted to deck 11 for reducing vibration in the machine that would otherwise be caused by the motion thereof.

The overall operation of the present invention can be appreciated wherein, feed inlet 14 delivers particulate matter to the surface of deck 11 as it is vibrated, and as the air flows through it. Flanges 13 serve to contain the particulate matter on deck 11 as such material is classified as to decreasing weight in a direction from deck end 18 to deck end 17. The classifed material is the emptied into discharge 16.

It is desireable that the rotational speed of eccentric shaft 74, hence the rate of vibration of deck 11, be adjustable to provide for the specific separating requirements of various grains or other particulate matter. Rotation of handle 119 will, through rod 118, adjust the position of support 116 about shaft 117. In this manner, the position of pulley 114 can be adjusted so as to increase or decrease the tension on belt 120. As a result thereof, the operational circumference of pulley 112 can be adjusted, thereby changing the speed at which eccentric shaft 74 rotates.

The tendency for any vibrations to occur in the present invention are significantly reduced by the fact that fan 41 rotates about an axis that is substantially perpendicular to the axis of rotation of jack shaft 102 and eccentric shaft 74. The rotation of the various components associated with fan shaft 44, and in particular fan 41, operates to cancel or oppose, in a gyroscopic manner, the motion of the components rotating about the axes of jack shaft 102 and eccentric shaft 74. In this manner, the occurrence of vibrations is greatly reduced during operation of the present invention.

The present invention may be embodied in other specific forms without departing from the spirit or scope of the essential attributes thereof, and it is therefore desired that the present embodiment be considered in all respects as illustrative and not restrictive, reference being made to the appended claims rather than to the foregoing description to indicate the scope of the invention.

What is claimed:

1. A gravity separator for classifying particulate matter as to weight, comprising:

an inclined deck over which such material passes for classification, a housing underlying the deck and having means confining air flow upwardly through the deck, the housing also having means supporting the deck thereon and the housing having a partition traversing the housing intermediate its height, the partition having an air directing means at its center and the housing having a vent through the exterior thereof below the partition, the air directing means being a venturi, a drive means for oscillating the deck including an eccentric shaft rotating about a horizontal axis, a fan attached to the air directing means for providing air flow through the deck, and the fan having a shaft oriented transversely to the eccentric shaft, a drive motor rotatively coupled to the fan and the eccentric shaft for providing rotational driving thereof.

2. A gravity separator for classifying particulate matter as to weight, comprising:

an inclined deck over which such material passes for classification, a housing underlying the deck and having means confining airflow upwardly through the deck, the housing also having means supporting the deck thereon, and the housing having a partition traversing the housing intermediate its height, the partition having a venturi at its center and the housing having a plurality of vents through the exterior thereof below the plane of the support, a drive means for oscillating the deck and including a horizontal drive shaft with an eccentric thereon and rotating about a horizontal axis, and a drive rod pivotally connected on one end to the deck and on its opposite end to an eccentric crank on the eccentric, a counterweight rotatively affixed to a counterweight crank affixed to the eccentric shaft, the counterweight crank 180° out of phase with the drive rod crank for providing a motion to the counterweight opposite the motion of the deck, a fan attached to the venturi for providing air flow through the deck, and the fan having a vertical shaft oriented transversely to the eccentric shaft, a drive motor with a vertical axis of rotation and rotatively coupled to the fan by a first fan pulley attached to the drive motor, a second fan pulley attached to the fan shaft and a fan belt engaging the first fan pulley to the second fan pulley, and the drive motor rotatively coupled to the eccentric shaft by a first motor pulley connected to the drive motor and a first jack shaft pulley connected to a jack shaft, the jack shaft adjacent the eccentric shaft and extending in an axis substantially parallel thereto, and a jack shaft belt engaging the first motor pulley to the first jack shaft pulley, and a second jack shaft pulley connected to the jack shaft and an eccentric shaft pulley connected to the eccentric shaft and an eccentric shaft drive belt engaging the second jack shaft pulley to the eccentric shaft pulley.

3. The gravity separator as defined in claim 2 and further comprising, a shoe below the deck and secured thereto and a bellows extending around and secured to the perimeter of the shoe and depending therefrom and secured to the upper perimeter of the housing.

* * * * *